United States Patent [19]

Guest, Sr.

[11] Patent Number: 4,488,677

[45] Date of Patent: Dec. 18, 1984

[54] MAILBOX CONSTRUCTION

[76] Inventor: Arnold R. Guest, Sr., 1612 Huntington Dr., NW., Marietta, Ga. 30066

[21] Appl. No.: 493,508

[22] Filed: May 11, 1983

[51] Int. Cl.[3] ..... B65D 91/00

[52] U.S. Cl. ..... 232/34; 232/17; 232/33

[58] Field of Search ..... 232/17, 20, 21, 24, 232/26, 32, 33, 34, 35, 38, 1 C

[56] References Cited

U.S. PATENT DOCUMENTS

| | | | |
|---|---|---|---|
| 908,543 | 1/1909 | Brown | 232/34 |
| 930,922 | 8/1909 | Bates | 232/34 |
| 1,456,543 | 5/1923 | Feist | 232/35 |
| 2,032,618 | 3/1936 | Kenyon | 232/17 |
| 2,561,007 | 7/1951 | Bierig | 232/17 |
| 3,134,538 | 5/1964 | Fibus | 232/17 |
| 3,960,317 | 6/1976 | Clement | 232/34 |

*Primary Examiner*—Gene Mancene
*Assistant Examiner*—Kris R. Schulze
*Attorney, Agent, or Firm*—Harvey B. Jacobson; Clarence A. O'Brien

[57] ABSTRACT

A mailbox with a hinged access door includes a door-operating handle having an indicator plate or flag which can be moved between alternative positions when opening and closing the door to indicate respectively that mail is to be collected from the box or the mail has been collected and/or delivered. The handle is positioned to rest on the lower portion of the mail delivery vehicle window opening to support the mailbox door when in open position. Also, the interior of the mailbox includes a mail holder to retain outgoing mail in a conveniently accessible position so that the mail delivery person may make a quick and easy pickup of the mail.

4 Claims, 6 Drawing Figures

MAILBOX CONSTRUCTION

BACKGROUND OF THE INVENTION

This invention relates to a mailbox construction, more particularly suitable for use in rural and other localities where it is common practice for mailmen both to deliver and collect mail from customer's individual mailboxes.

It is known for mailboxes used in the above application to have some form of multi-position indicating device, such as a flag mounted on one side of the box, for signalling when in one position, that outgoing mail is to be collected from the box and, when in another position that the collection has been made or that incoming mail has been delivered to the box. The present invention provides an improved mailbox of this nature.

DESCRIPTION OF THE PRIOR ART

Applicant is aware of the following U.S. patents relating to mailboxes in general:

U.S. Pat. No. 1,122,855, Dec. 29, 1914
U.S. Pat. No. 2,650,756, Sept. 1, 1953
U.S. Pat. No. 2,760,721, Aug. 28, 1956
U.S. Pat. No. 2,811,306, Oct. 29, 1957
U.S. Pat. No. 3,515,337, June 2, 1970
U.S. Pat. No. 4,247,039, Jan. 27, 1981

SUMMARY OF THE INVENTION

In accordance with the present invention, a mailbox having an access door is provided with a door-operating handle also serving as a signal means for indicating different mail conditions within the box. For example, the handle means may be movable relative to the door between a first position indicating that outgoing mail is to be collected from the box, and a second position indicating that a collection has been made or that incoming mail has been delivered to the box. With this arrangement, the signal means can be operated simultaneously with opening and closing the box, rather than requiring a separate operation at the side of the box, so that mailmen may be more receptive to using the indicator.

In one preferred form of the invention, for a mailbox having a hinged front-opening door, the handle means may comprise a rod connected to the door at one end by a ball and socket joint, and having an indicator plate at its free end forming a handle. With this construction, when opening or closing the box, the rod may be swivelled about its axis to move the plate between vertical and horizontal indicating positions. Also, the rod may be pivoted vertically when opening the door so that, for example, it may be brought to rest on a sill of a mail delivery vehicle, to form a shelf.

Another feature of the invention resides in the provision of a letter holder in a front corner of the mailbox which assists in locating mail placed in the box.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
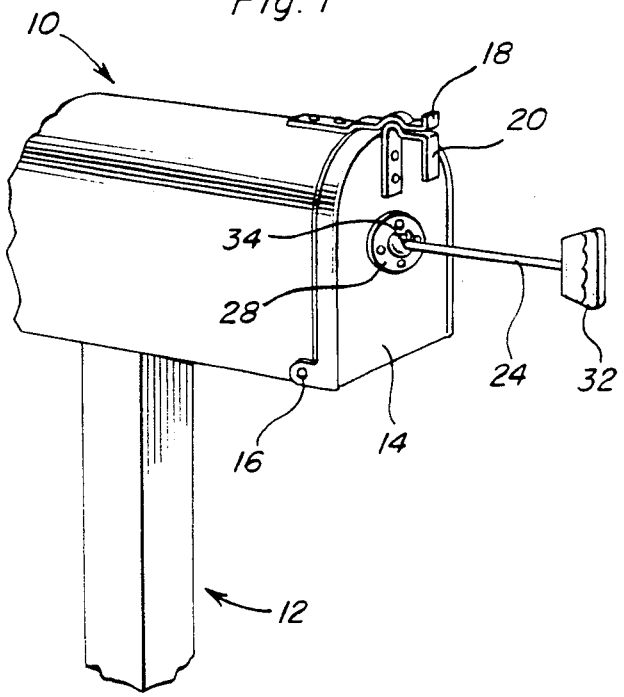
FIG. 1 is a perspective view of a mailbox in accordance with the invention awaiting a mail pickup.
Figure 4:
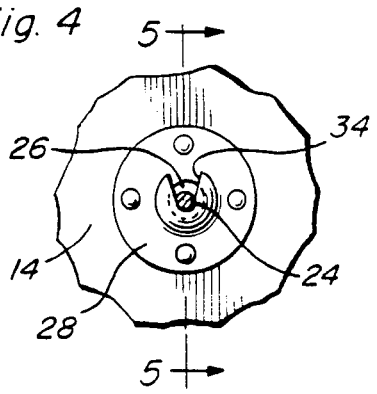
FIG. 4 is a sectional view on line 4—4 of FIG. 3.

A mailbox 10 in accordance with the invention, is shown mounted (FIGS. 1 and 2) atop a mounting post 12 or the like. Box 10 may be of a generally known construction fabricated, for example, from light-gauge sheet metal and may be mounted to post 12 by any convenient mounting means (not shown).

At its back end, the box may be closed by a rear wall (not shown) and the front end of the box may have a hinged access door 14 whereby mail may be delivered to or removed from the box. Conveniently, door 14 may hinge about a pivot 16, and resilient clip members 18 and 20 may be provided for releasably retaining the door in closed position with clip 20 also forming the usual handle for opening and closing the door.

Figure 5:
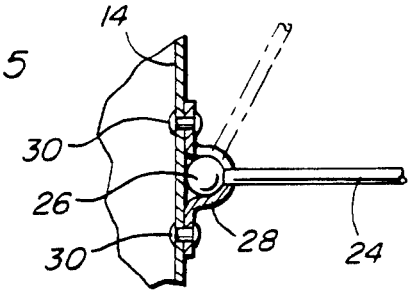
FIG. 5 is a sectional view on line 5—5 of FIG. 4.
Figure 2:
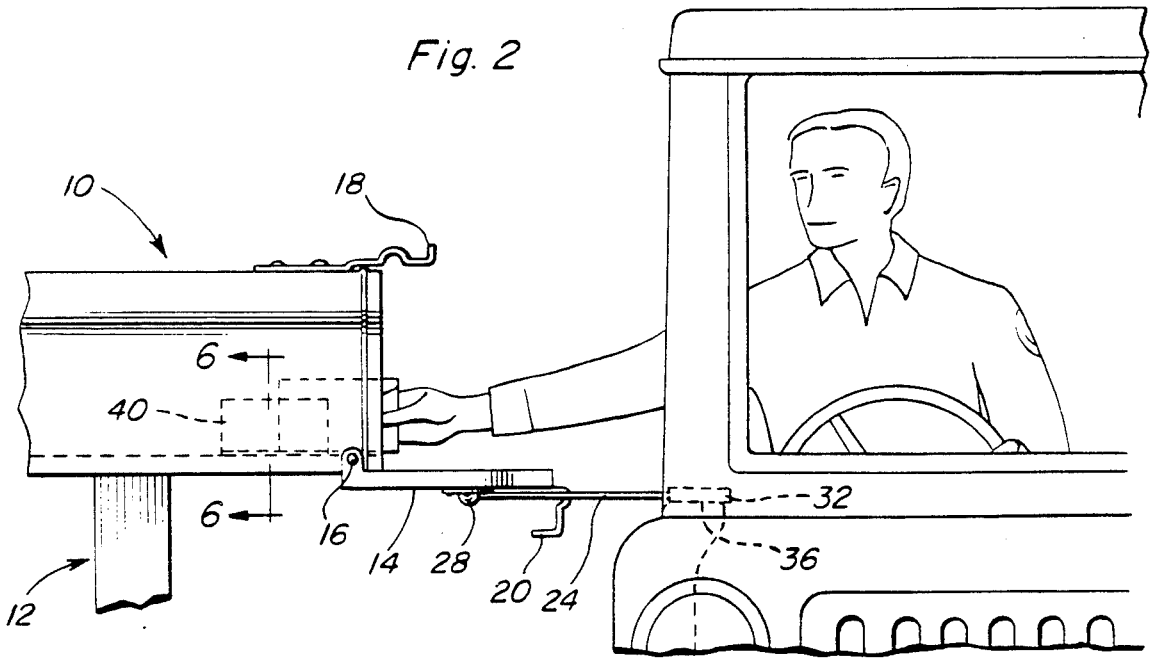
FIG. 2 is a side view of the box in open condition illustrating the manner in which mail may be delivered or removed.
Figure 3:
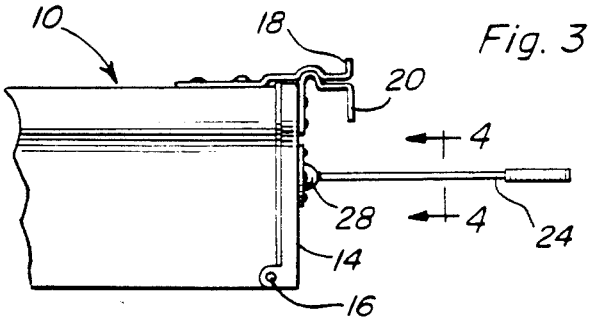
FIG. 3 is a side view of the box in closed condition after receiving a mail delivery.

Attached to the front of door 14 is a handle and indicator flag assembly comprising an elongate rod 24 with a ball 26 attached at one end thereof, a domed socket plate 28 receiving the ball and having a flange connected to door 14 by rivets 30 or the like (FIG. 5), and a colored handle 32 also forming an indicator plate or flag at the free end of rod 24. Plate 32 may be of a suitably colored plastic, for example. The construction of the ball 26 and socket plate 28 allows rod 24 to be swivelled about its longitudinal axis, whereby the orientation of indicator plate 32 may be changed between the vertical (FIG. 1) and the horizontal (FIGS. 2 and 3). Further, socket plate 28 is notched at 34 allowing the rod to pivot vertically as shown in FIG. 5.

When, for example, a householder places outgoing mail in the box for collection, the indicator plate may be placed in the vertical orientation (FIG. 1) signalling to a mailman that there is mail in the box to be collected. The mailman may pull on plate 32 to open the box, lowering door 14, and pivoting arm 24 relative to the door. This movement may be accompanied by a twisting of rod 24 by means of the indicator plate, so as to horizontally orientate the plate. When collecting mail, plate 32 may be brought to rest on sill 36 of a mail delivery vehicle 38, whereby door 14 forms a convenient shelf aligned with the lower edge of the window opening. The orientation of notch 34 is such that when rod 24 pivots into line with door 14 (FIG. 2), it is located to one side of clip member 20.

When the outgoing mail has been collected, and any incoming mail delivered, door 14 may again be closed accompanied by relative pivoting of rod 24 about the ball and socket connection. In the closed condition, (FIG. 3) plate 22 may be left in its horizontal orientation indicating that mail has been collected and/or delivered. If the outgoing mail is collected but no incoming mail is delivered, the mail delivery person may swing the rod to a vertical position with the flag parallel to the roadway or street thus enabling the occupant of a dwelling to ascertain that a trip to the mailbox is unnecessary. When the householder again leaves outgoing mail for collection, rod 24 may be moved to horizontal position and plate 32 may be restored to its vertical orientation (FIG. 1).

Figure 6:
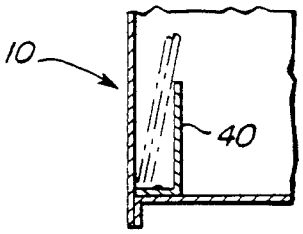
FIG. 6 is a sectional view on line 6—6 of FIG. 2.

As shown in FIGS. 2 and 6, a letter holder in the form of a vertical plate 40 with a bottom flange may be provided in a front corner of the box. By placing letters in the holder rather than depositing them randomly in the box, collection of the letters by a mailman is facilitated.

It will be appreciated from the foregoing that mailboxes as herein described and illustrated offer convenience, efficiency and time saving in mail collection and delivery.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A mailbox having an access door, door-operating handle means for opening and closing the door, and means for enabling the handle means to indicate alternative mail conditions of the box, wherein the enabling means includes mounting means attaching the handle means to the door for movement between a first position indicating mail is to be collected from the box and a second position indicating that mail has been collected and/or delivered, wherein the handle means comprises an indicator plate and the mounting means includes means for orienting said plate vertically in one of said positions and horizontally in the other of said positions, and wherein the plate is mounted at one end of an elongate rod, and the other end of the rod is connected to the door by a ball and socket connection allowing the rod to swivel about its longitudinal axis to move the plate between said positions.

2. A mailbox as defined in claim 1 wherein the door has a hinge connection with the box for opening and closing the door, and the ball and socket connection includes means for providing pivotal movement of the rod about the ball and socket connection during opening and closing of the door.

3. A mailbox as defined in claim 1 including a letter holder within the interior of the box for placing letters in predetermined location in the box.

4. A mailbox as defined in claim 3 wherein the letter holder includes a vertical plate in one corner of the box adjacent the access door.

* * * * *